US006298579B1

(12) United States Patent
Ichitani et al.

(10) Patent No.: US 6,298,579 B1
(45) Date of Patent: Oct. 9, 2001

(54) FLUIDIZED-BED DRYING AND CLASSIFYING APPARATUS

(75) Inventors: Noboru Ichitani, Hyogo-ken; Isao Hayashi, Takasago; Mikio Murao, Kobe, all of (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/581,898

(22) Filed: Jun. 20, 2000

(30) Foreign Application Priority Data

Jan. 27, 1988 (JP) ..... 10-305061

(51) Int. Cl.[7] ..... F26B 21/00

(52) U.S. Cl. ..... 34/565; 34/570; 34/579; 34/582; 34/588; 34/102; 209/154

(58) Field of Search ..... 34/552, 554, 565, 34/570, 579, 558, 582, 588, 591, 364, 369, 492, 493, 495, 102; 209/154, 139.1

(56) References Cited

U.S. PATENT DOCUMENTS 4,360,976 * 11/1982 Meckel et al. ..... 34/168
5,526,938 * 6/1996 Kraft et al. ..... 209/139.1

FOREIGN PATENT DOCUMENTS 05071875 3/1993 (JP) .
06281110 10/1994 (JP) .
06287043 10/1994 (JP) .
6-277495 10/1994 (JP) .
06343927 12/1994 (JP) .
7-11270 1/1995 (JP) .
10-246573 9/1998 (JP) .
11-51314 2/1999 (JP) .

* cited by examiner

*Primary Examiner*—Jiping Lu
(74) *Attorney, Agent, or Firm*—Oliff & Berridge, PLC

(57) ABSTRACT

A fluidized-bed drying and classifying apparatus is provided with a main body (10) in which a fluidized bed is formed to dry a granular material and to classify the same into fine particles and coarse particles. A perforated gas-distributing plate (12) is disposed in a lower part of a region in which a fluidized bed (14) is formed in the main body (10), a wind box having the shape of a hopper is disposed below the perforated gas-distributing plate. A dropped material discharge device (29) is connected to the lower end of the hopper-shaped wind box (16) to discharge the material dropped into the wind box (16). A gas supply system (110) is connected to the wind box (16) to supply a fluidizing gas that serves as a drying hot gas and a classifying gas into the wind box. A material supply opening portion (20) is mounted to the main body (10) to feed the granular material. A discharge chute (24) is connected to the main body (10) to discharge dried coarse particles. A gas discharge opening portion (56) is connected to the main body (10) to discharge an exhaust gas containing fine particles. The gas supply system (110) includes a flow controller (111) to control classification particle size by controlling the flow rate of the gas supplied into the wind box (16), and a temperature controller (112) to control drying degree through the adjustment of temperature of the hot gas supplied into the wind box (16) according to the adjusted flow rate.

12 Claims, 11 Drawing Sheets

FLUIDIZED-BED DRYING AND CLASSIFYING APPARATUS

TECHNICAL FIELD

The present invention relates to a fluidized-bed drying and classifying apparatus for drying a material of a wide particle size distribution, such as coal, slag, by hot air drying and classifying the material by air classification.

BACKGROUND ART

A fluidized-bed classifier disclosed in JP-A No. Hei 6-343927 adjusts classification particle size (freeboard flow velocity) by adjusting the flow velocity of a gas forming a fluidized bed to separate a mixture of particles into coarse particles held in the fluidized bed and fine particles scattered into the freeboard. The coarse particles are removed from the fluidized bed. A exhaust gas containing the fine particles is extracted from the freeboard and is delivered to a cyclone etc. to collect the fine particles.

It is mentioned in JP-A No. Hei 6-343927 that an auxiliary classifying gas is supplied to a discharge chute for discharging the coarse particles from the fluidized bed to avoid discharging fine particles of particle sizes below the classification particle size together with the coarse particles through the discharge chute. It is also mentioned in this publication that the temperature of the fluidized bed is measured, and the gas forming the fluidized bed is heated so that the measured temperature of the fluidized bed coincides with a temperature necessary for drying the material.

When processing a material, such as coal or slag, by using a fluidized bed, some coarse particles of coal or slag are not fluidized even if a fluidizing gas is blown from below a gas-distributing plate because particle sizes of particles of coal or slag are distributed in a very wide particle size distribution.

According to the fluidized-bed apparatus disclosed in JP-A No. Hei 5-71875, a gas is jetted obliquely upward along the inclined surface of the gas-distributing plate to make coarse particles jump over a jumping board.

A large lump discharging apparatus for discharging large lumps from a fluidized bed disclosed in JP-A No. Hei 6-281110 has a gas-distributing plate disposed in a fluidized-bed furnace and provided with a recess in a central part thereof, and a large lump discharging chute penetrating a wind box and having an upper end connected to the recess.

Generally known gas-distributing plates are of a cap type or of a perforated type.

A cement clinker kiln disclosed in JP-A No. Hei 6-287043 includes a fluidized-bed kiln disposed below the gas distributing plate of a fluidized-bed granulating furnace, and burns cement clinker by supplying grains through a dropping opening facing the fluidized bed of the fluidized-bed granulating furnace into the fluidized-bed kiln. A gas is blown through the dropping opening into the fluidized-bed granulating furnace by a gas blowing means, and fine particles are separated from particles dropped through the dropping opening by adjusting the effective area of the dropping opening by adjusting the position of a classifying gate inserted in the dropping opening through the side wall of the furnace in the dropping opening.

The fluidized-bed classifier disclosed in JP-A No. Hei 6-343927 controls the flow rate of the fluidizing gas to adjust the classification particle size. Since temperature necessary for drying the material changes according to the flow rate of the fluidizing gas (gas flow rate), in some cases, the material cannot be dried in a desired drying degree. In other words, classification particle size and drying degree cannot be simultaneously adjusted because the gas flow rate and the hot air temperature are controlled individually. A satisfactory secondary classifying effect to separate fine particles of particle sizes below the classification particle size cannot be achieved only by supplying the auxiliary classifying gas to the coarse particle discharge chute. Replacement of the abraded or corroded perforated gas-distributing plate with a new one requires much time and great expense. When the material has a wide particle size distribution and contains much large particles, it is possible that the fluidized bed cannot be formed due to the stagnation of large particles in a space directly below a material supply unit.

When the conventional cap type gas-distributing plate is used, a large part of particles remains stationary and large particles do not move and do stagnate. Thus, the cap type gas-distributing plate is unsuitable for handling particles of particle sizes in a wide particle size distribution. Some troubles are caused by abrasion of the cap of the cap type gas-distributing plate and clogging of nozzles. When a perforated gas-distributing plate properly designed taking uniformity in jetting, stationary particles in spaces between nozzles and jetting height into consideration is used, all the material can be fluidized. Such a perforated gas-distributing plate is excellent in resistance to abrasion and clogging. However, a relatively large amount of the material drops through the perforated plate and deposits in the wind box.

The fluidized-bed apparatus disclosed in JP-A No. Hei 5-71875 needs to jet the gas at a very high velocity. Therefore, pressure loss in the fluidized-bed apparatus is great, the gas-distributing plate is abraded rapidly and the replacement of the gas-distributing plate with a new one takes much time and needs great expense. The gas-distributing plate of complicated construction requires complicated, troublesome maintenance work. Since a maximum particle size, i.e., the particle size of particles that can be carried, is dependent on gas jetting velocity, it is possible that large particles stagnate on the gas-distributing plate and stop the operation of the fluidize-bed apparatus. The velocity of the fluidized bed must be increased to ensure the conveyance of coarse particles and, consequently, the amount of scattered fine particles increases.

The large lump discharging apparatus for discharging large lumps from a fluidized bed disclosed in JP-A No. Hei 6-281110 discharges large lumps through the respective central parts of the gas-distributing plate and the wind box is complicated in construction and is incapable of surely discharging large lumps. Therefore, the deposition of large lumps increases with time and, eventually, the fluidity of the fluidized bed is deteriorated.

The cement clinker kiln disclosed in JP-A No. Hei 6-287043 employing the classifying gate disposed in the bottom of the fluidized-bed granulating furnace make particles float in a gas flow from the bottom of the granulating furnace. Since classifying gas velocity for separating fine particles is low, particles flow altogether into the classifying part of the chute and fill up the classifying part. Consequently, the apparatus is unable to fully exercise its classifying effect.

The present invention has been made in view of the foregoing problems. Therefore, it is an object of the present invention to provide a fluidized-bed drying and classifying apparatus which is capable of maintaining a satisfactory, stable fluidized bed when drying and classifying particles of a material having a wide particle size distribution, such as coal or slag, by using the fluidized bed and of adjusting both drying degree and classification particle size, and is simple in construction, inexpensive, safe, and easy to operate and maintain.

Another object of the present invention is to provide a fluidized-bed drying and classifying apparatus which is capable of operating at an improved classifying efficiency by greatly reducing the fine particle content of coarse particles, i.e., processed material, of maintaining a stable fluidized bed even if the material contains a large amount of coarse particles and lumps and of surely preventing the inclusion of large lumps in a processed material.

DISCLOSURE OF THE INVENTION

To achieve the objects, the present invention provides a fluidized-bed drying and classifying apparatus having a main body in which a fluidized bed is formed to dry a granular material and to classify the granular material into fine particles and coarse particles, which includes: a perforated gas-distributing plate disposed under a fluidized bed formed in the main body; a wind box having the shape of a hopper and disposed below the perforated gas-distributing plate; a dropped material discharge device connected to a lower end of the hopper-shaped wind box to continuously discharge the material dropped into the wind box; a gas supply system connected to the wind box to supply a fluidizing gas that serves as a drying hot gas and a classifying gas into the wind box; a material supply opening portion mounted to one end of the main body to feed the granular material; a discharge chute mounted to the other end of the main body to discharge dried coarse particles; a gas discharge opening portion disposed on an upper part of the main body to discharge an exhaust gas containing fine particles. The gas supply system includes a flow controller to control classification particle size (which corresponds to freeboard velocity) by controlling the flow rate of a gas supplied into the wind box, and a temperature controller to control drying degree through the adjustment of the temperature of the hot gas supplied into the wind box according to the adjusted flow rate (FIG. 1). The dropped material discharge device may be controlled so as to discharge dropped material intermittently at a frequency determined on the basis of rate of dropping of the dropped material. The perforated gas-distributing plate is formed of, for example, a stainless steel of a grade, such as SUS304, with a view to preventing the corrosion of the gas-distributing plate.

In the fluidized-bed drying and classifying apparatus according to the present invention, it is preferable to connect a lump discharge device to the perforated gas-distributing plate disposed below the fluidized bed formed directly below the material supply opening portion to discharge coarse particles of particle sizes not smaller than a particle size that makes fluidized-bed superficial velocity and minimum fluidization velocity equal to each other (FIG. 4). Since coarse particles (lumps) can be discharged by the lump discharge device when the amount of coarse particles of particle sizes not smaller than the particle size that makes fluidized-bed superficial velocity and minimum fluidization velocity equal to each other is not smaller than 8% by weight, desirably, 3% by weight of the amount of processed material, the stable fluidized bed can be maintained with reliability.

In the fluidized-bed drying and classifying apparatus according to the present invention, it is preferable to attach a replaceable liner to the perforated gas-distributing plate to prevent the abrasion of the perforated gas-distributing plate. With a view to preventing corrosion as well as abrasion, the liner is made of, for example, a stainless steel of a grade, such as SUS304.

In any one of the foregoing fluidized-bed drying and classifying apparatuses according to the present invention, it is preferable to dispose a dam near an end of the perforated gas-distributing plate on the side of the discharge chute, and to connect a classifying gas supply nozzle to the discharge chute to return fine particles into the main body by blowing up the fine particles over the dam.

In any one of the foregoing fluidized-bed drying and classifying apparatuses according to the present invention, it is preferable to dispose a dam near an end of the perforated gas-distributing plate on the side of the discharge chute, to dispose a classifying plate above the dam to improve classifying efficiency by reducing the sectional area of a space between the dam and the classifying plate, and to connect a classifying gas supply nozzles to the discharge chute to return fine particles into the main body by blowing a gas through the space between the dam and the classifying plate. The classifying plate may be omitted by properly determining the height of the upper wall of the discharge chute.

In the foregoing fluidized-bed drying and classifying apparatus according to the present invention, it is preferable that at least either the height of the dam or the height of the classifying plate is adjustable so that the amount of classification can be adjusted by changing the sectional area of the space between the dam and the classifying plate. When the height of the dam is adjustable, the height of the dam and, hence, he height of the fluidized bed can be adjusted so as to adapt o the characteristic of particles.

In the foregoing fluidized-bed drying and classifying apparatus according to the present invention, it is preferable hat either the height or the angle of the classifying plate is adjustable to adjust the amount of classification by changing the sectional area of the space between the dam and the classifying plate. It is preferable that the classifying plate is of a flap type that can be set in a desired inclined position or of an adjustable-height type to achieve optimum secondary classification. When the classifying plate is of a flap type, falling fine particles can be returned into the main body by setting the classifying plate so that the lower end thereof is directed toward the interior of the main body.

In any one of the foregoing fluidized-bed drying and classifying apparatuses according to the present invention, it is preferable to form a gap (slit) that allows the passage of lumps between the lower end of the dam and the upper surface of the perforated gas-distributing plate.

In any one of the foregoing fluidized-bed drying and classifying apparatuses according to the present invention, it is preferable to divide the discharge chute by a partition wall to form a lump discharge chute in the discharge chute on the side of the perforated gas-distributing plate and to provide the side portion of the lump discharge chute with a fluidizing gas blowing nozzle for fluidizing particles in an upper part of the lump discharge chute to make large lumps fall selectively and to discharge large lumps. It is desirable that the velocity of the fluidizing gas blown through the fluidizing gas blowing nozzles is in the range of 1 to 3 times, more desirably, in the range of 1.5 to 2 times the minimum fluidization velocity $U_{mf}$. If the minimum fluidization velocity is lower than the lower limit of the foregoing velocity range, it is difficult to move large lumps. If the minimum fluidization velocity is higher than the upper limit of the foregoing velocity range, particles are mixed excessively in the discharge chute and the fluidized bed and hence it is difficult to extract lumps selectively from the fluidized particles.

In any one of the foregoing fluidized-bed drying and classifying apparatuses according to the present invention, it is preferable that a lump discharge portion is formed at a discharging part of the discharge chute on the side of the perforated gas-distributing plate, a lump discharge chute is connected to the lump discharge portion, and a side wall of the lump discharge chute is provided with a fluidizing gas blowing nozzle to fluidize particles in an upper part of the lump discharge chute so that large lumps fall selectively and are discharged.

In any one of the foregoing fluidized-bed drying and classifying apparatuses according to the present invention, it is preferable that the discharge chute is divided by a partition wall so as to form a lump discharge chute in the discharge chute on the side of the perforated gas-distributing plate, a side wall of the lump discharge chute is provided with a fluidizing gas blowing nozzle to fluidize particles in an upper part of the lump discharge chute so that large lumps fall selectively and are discharged, a lower part of the lump discharge chute is inclined, a sieving structure is formed at least in a part of a lower wall of the inclined lower part of the lump discharge chute, a partition wall is disposed in the discharge chute so as to define a space below the sieving structure, and particles of small particle sizes dropped in the lump discharge chute are sieved out into the space below the sieving structure and are returned into the discharge chute.

In the foregoing fluidized-bed drying and classifying apparatus according to the present invention, it is preferable that the upper end of the partition wall is on a level above that of the upper surface of the perforated gas-distributing plate. Generally, slag contains particles of particle sizes in the range of 2 to 3 mm and lumps of particle sizes in the range of 80 to 100 mm. When processing such slag, the partition wall is disposed so that the upper end thereof is higher than the upper surface of the perforated gas-distributing plate by 100 to 200 mm to prevent lumps from entering the coarse particle discharge chute.

The present invention having the above-mentioned constitutions exercises the following effects.

(1) The flow rate of the fluidizing gas is adjusted so that a desired classification particle size is attained, a temperature at which the hot air must be heated to achieve a desired drying degree is calculated taking the flow rate into consideration, and then the temperature of the hot air is controlled. Therefore, the fluidizing gas is supplied at a velocity necessary to maintain a normal fluidized bed and both the drying degree and the classification particle size can be adjusted.

(2) The use of the perforated gas-distributing plate prevents stationary particles and stagnation of coarse particles, and enables maintaining a satisfactory, stable fluidized bed. Since the perforated gas-distributing plate is simple in construction, the perforated gas-distributing plate is inexpensive, not subject to abrasion and clogging, and easy to maintain. High jetting speed is unnecessary for carrying coarse particles and pressure loss attributable to the distributing plate is low. The fluidized-bed velocity may be low and the amount of scattered fine particles is small.

(3) The perforated gas-distributing plate enables the formation of a uniform fluidized bed and is simple in construction and inexpensive. When the detachable liner is attached to the perforated gas-distributing plate, the maintenance of the perforated gas-distributing plate is very easy.

(4) Since the wind box has the shape of a hopper and particles dropped into the wind box are discharged continuously by the dropped material discharge device, the dropped material is not accumulated in the wind box, which ensures safety and stabilizes the fluidized bed.

(5) When the material contains coarse particles and large lumps in high ratios, the lump discharge device is disposed at a position directly below the material supply opening portion to discharge part of coarse particles to fluidize all the material normally and a stable operation can be continued.

(6) When particles flow over the dam disposed near the end of the perforated gas-distributing plate into the discharge chute and the classifying gas is blown into the discharge chute, the classifying gas blown into the discharge chute returns fine particles into the main body. Therefore, the fine particle inclusion of the coarse particles, i.e., the processed material, is reduced greatly and classifying performance is improved.

(7) When the classifying plate is disposed above the dam and the height of the dam and/or the height of the angle of the classifying plate is adjustable, the sectional area of the space between the dam and the classifying plate can be changed, so that the velocity of the gas flowing from the discharge chute into the main body can be changed to change the amount of classification, which further improves classifying efficiency.

(8) When the lump discharge chute is formed in the discharge chute, the lump inclusion of coarse particles, i.e., the processed material, can be prevented with reliability. The lump discharge chute is simple in construction as compared with the conventional lump discharge means penetrating the gas-distributing plate and the wind box. Since the lump discharge chute does not penetrate the wind box, the lump discharge chute is not exposed to a high-temperature gas for a long time and is under very safety condition.

(9) Lumps supplied into the fluidized bed are collected eventually in a region in the vicinity of the discharge end and the collected lumps can be efficiently discharged.

(10) When the sieving structure, such as a grizzly or a metal net, is disposed in a lower part of the discharge chute, particles of normal particle sizes (processed material) flowed together with lumps into the lump discharge chute can be returned into the particle discharge chute to reduce the particle inclusion of the lumps and only lumps can be selectively discharged.

BEST MODE FOR CARRYING OUT THE INVENTION

Preferred embodiments of the present invention will be described hereinafter. The present invention is not limited in its practical application to the preferred embodiments specifically described herein and changes and variations are possible therein.

Figure 1:
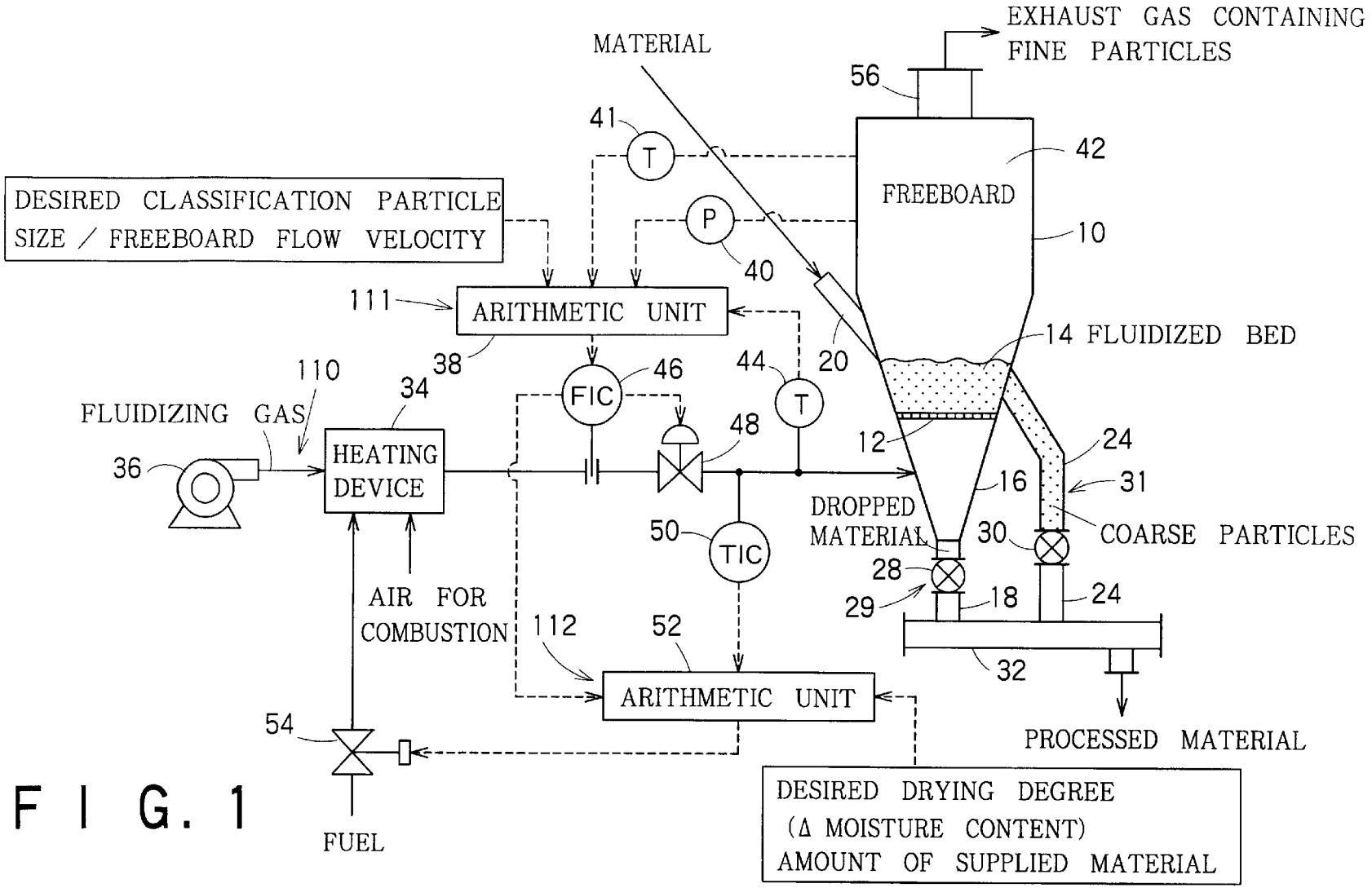
FIG. 1 is a diagrammatic view of a fluidized-bed drying and classifying apparatus in a first embodiment according to the present invention.

FIG. 1 shows a fluidized-bed drying and classifying apparatus in a first embodiment according to the present invention. Referring to FIG. 1, a perforated gas-distributing plate 12 is disposed in a lower part of a main body 10. A fluidized bed 14 containing a material, such as wet granular coal, as a bed material is formed over the perforated gas-distributing plate 12.

A wind box 16 having the shape of a hopper, i.e., a structure having a longitudinal section substantially resembling an inverted triangle and an open bottom, is disposed under the perforated gas-distributing plate 12. A dropped material discharge system 29 is connected to the lower end of the wind box 16 to discharge the material dropped into the wind box 16. The dropped material discharge system 29 includes a dropped material discharge device 28 and a dropped material discharge chute 18.

A material supply opening portion 20 for supplying granular material, i.e., a material to be processed, is connected to a part of the main body 10 on a level above the fluidized bed 14. A processed material discharge system 31 is connected to a part of the main body to discharge the processed material (dried coarse particles). The processed material discharge system 31 includes a processed material discharge chute 24 and a discharge device 30. The discharge devices 28 and 30 are gate dampers, rotary feeders, discharge devices operated by a cam mechanism for opening and closing operation or discharge devices operated by a balance weight for opening and closing operation.

The dropped material discharge chute 18 and the processed material discharge chute 24 are connected to a carrying device 32. The processed material is discharged from a discharge end of the carrying device 32. The carrying device 32 is a screw conveyor, a belt conveyor or a chain conveyor.

A gas supply system 110 is connected to a side wall of the wind box 16 to supply a fluidizing gas that serves as a hot drying gas and a classifying gas into the wind box 16. The gas supply system 110 includes a flow rate control unit 111 that adjust the flow rate of the gas supplied into the wind box 16 to control classification particle size, and a temperature control unit 112 that adjusts the temperature of the hot gas supplied into the wind box 16 according to the flow rate determined by the flow rate control unit 111 to control drying degree.

The operation of the fluidized-bed drying and classifying apparatus shown in FIG. 1 will be described hereinafter. A granular material (material to be processed), such as wet coal, is supplied through the material supply opening portion 20 into the main body 10, and the fluidizing gas is supplied into the wind box 16 by the gas supply system 110. The fluidizing gas is used not only for forming the fluidized bed 14 of the material but also for the hot-gas drying of the material and for classification.

In order to produce the fluidizing gas, a high temperature hot gas is produced by supplying a fuel and combustion air to a heating device 34, such as a hot-air furnace, and burning the fuel in the heating device 34. The temperature of the high temperature hot gas produced by the heating device 34 is lowered to a temperature in the range of, for example, about 250 to 400° C. by mixing an auxiliary gas, such as air or a gas discharged after being used for drying and classification. Then, the hot gas, i.e. the mixture of the high temperature hot gas and the auxiliary gas, is supplied into the wind box 16. More specifically, a freeboard temperature is in the range of, for example, 50 to 80° C., and the temperature of the hot gas is in the range of, for example, 250 to 400° C. More exactly, the flow rate and the temperature of the fluidizing gas are dependent on the amount of the material supplied into the main body and desired drying degree (Δmoisture). When the exhaust gas discharged from the fluidized-bed drying and classifying apparatus is used as the auxiliary gas for adjusting the temperature of the fluidizing gas, it is safe even in adjusting, for example, the moisture content of coal because the fluidizing gas has a low oxygen concentration. In FIG. 1, indicated at 36 is an air blower the heating device 34 may be a direct heater for a hot-air furnace or an indirect heater.

Figure 2:
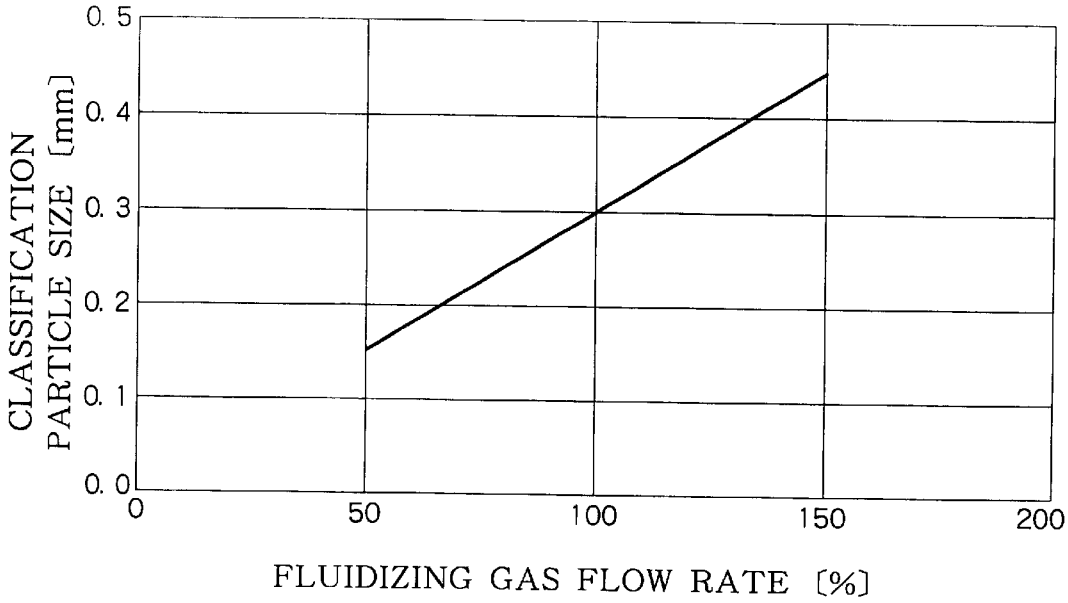
FIG. 2 is a graph showing the dependence of classifying particle size on the amount of a fluidizing gas in the fluidized-bed drying and classifying apparatus in the first embodiment.

When controlling both drying degree and classification particle size by the apparatus shown in FIG. 1, a freeboard velocity for achieving a desired classification particle size is given to an arithmetic unit 38 because classification particle size is dependent on freeboard velocity, and a flow rate at which the fluidizing gas is to be supplied to the wind box 16 is calculated on the basis of the pressure in the freeboard 42 measured by a pressure gage 40, the temperature of the freeboard 42 measured by a thermometer 41 and the temperature of the fluidizing gas measured by a thermometer 44. The flow rate calculated by the arithmetic unit 38 is given to a flow rate indicating controller (FIC) 46, the flow rate indicating controller (FIC) 46 controls a flow control valve 48 to supply the fluidizing gas at a flow rate to achieve a desired classification particle size into the wind box 16. As shown in FIG. 2 by way of example, the classification particle size varies linearly with the flow rate of the fluidizing gas. When a flow rate to achieve a classification particle size of 0.3 mm is 100% (freeboard velocity is approximately 1.5 m/s), the flow rate of the fluidizing gas is proportional to the classification particle size when flow rate of the fluidizing gas is in the range of 50 to 150%.

Figure 3:
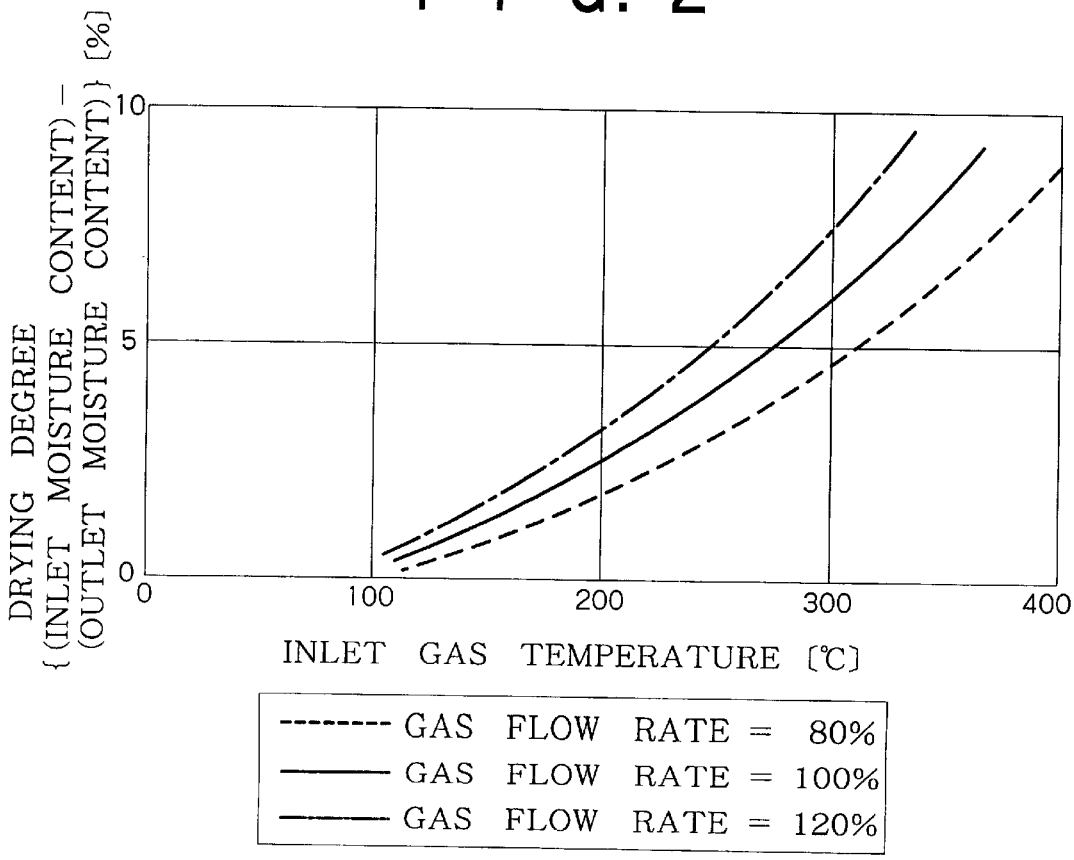
FIG. 3 is a graph showing the dependence of drying degree on the inlet temperature of a gas for the amount of a fluidizing gas as a parameter in the fluidized-bed drying and classifying apparatus in the first embodiment.

A flow rate determined by the flow rate indicating controller (FIC) 46 and the temperature of the fluidizing gas supplied into the wind box 16 measured by a temperature indicating controller (TIC) 50 are given to an arithmetic unit 52. Values of drying degree and the amount of supplied material that makes the difference between inlet moisture content (the moisture content of the material supplied) and outlet moisture content (the moisture content of the processed material) equal to a desired drying degree are given to the arithmetic unit 52. Then, the arithmetic unit 52 calculates a hot gas temperature necessary to achieve the desired drying degree according to the flow rate of the fluidizing gas. A fuel flow control valve 54 for controlling the flow rate of the fuel to be supplied to the heating device 34 is controlled on the basis of the hot gas temperature calculated by the arithmetic unit 52. As shown in FIG. 3 by way of example, values of the gas temperature to achieve the desired drying degree (the difference between the inlet moisture content and the outlet moisture content) for different flow rates of the fluidizing gas (80%, 100% and 120% in FIG. 2) are different; the higher the flow rate, the lower is the gas temperature for the same drying degree.

The fluidizing gas of a temperature and a flow rate determined so as to achieve the desired classification particle size and the desired drying degree is supplied into the wind box 16, the fluidizing gas is jetted through the perforated gas-distributing plate 12. Consequently, the material is fluidized and dried, fine particles of particle sizes smaller than the classification particle size are scattered into the freeboard 42, the fine particles are discharged together with the exhaust gas through a gas discharge opening portion 56, and coarse particles of particle sizes not smaller than the classifying particle size are discharged as processed material (product) by the processed material discharge system 31. The exhaust gas containing fine particles is discharged through the gas discharge opening portion 56 and is delivered to a dust collector, not shown, such as a cyclone and/or a bag filter. The dust collector collects the fine particles and removes the same from the exhaust gas. Particles passed through the jetting holes of the perforated gas-distributing plate 12 are discharged by the dropped material discharge system 29. The dropped particles may be continuously discharged. When the dropped particles accumulate at a low rate, the dropped particles may be discharged intermittently. The dropped material discharge device 28 may be operated continuously to discharge the dropped particles continuously.

Figure 4:
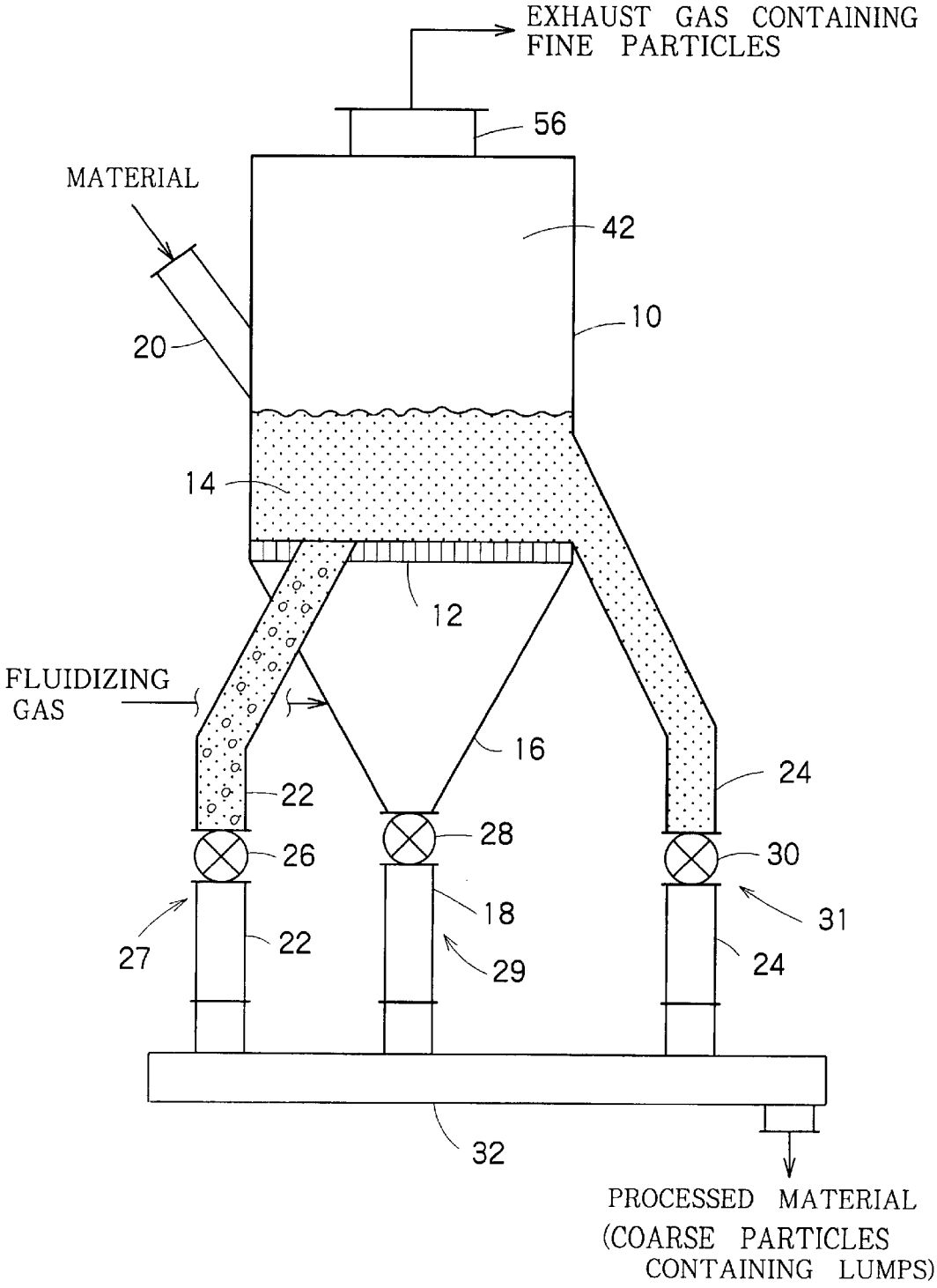
FIG. 4 is a schematic view of an essential part of a fluidized-bed drying and classifying apparatus in a second embodiment according to the present invention.

FIG. 4 shows a fluidized-bed drying and classifying apparatus in a second embodiment according to the present invention. Referring to FIG. 4, a perforated gas-distributing plate 12 is disposed in a lower part of a main body 10. A fluidized bed 14 containing a material is formed over the perforated gas-distributing plate 12.

A wind box 16 having the shape of a hopper is disposed under the perforated gas-distributing plate 12. A dropped material discharge system 29 is connected to the lower end of the wind box 16 to discharge the material dropped into the wind box 16. The dropped material discharge system 29 includes a dropped material discharge device 28 and a dropped material discharge chute 18.

A material supply opening portion 20 is connected to a part of the main body 10 on a level above the fluidized bed 14. A lump discharge system 27 including a lump discharge chute 22 and a discharge device 26 is connected to a part of the perforated gas-distributing plate 12 in a region directly below the material supply opening portion 20. The discharge device 26 is a gate damper, a rotary feeder, a discharge device operated by a cam mechanism for opening and closing operation or a discharge device operated by a balance weight for opening and closing operation.

A processed material discharge system 31 including a processed material discharge chute 24 and a discharge device 30 is connected to the main body at a position corresponding to one end of the fluidized bed 14.

The lump discharge chute 22, the dropped material discharge chute 18 and the processed material discharge chute 24 are connected to a carrying device 32. The processed material containing lumps is discharged from a discharge end of the carrying device 32. The lump discharge chute 22 need not be connected to the carrying device 32, and lumps and the processed material may be separately discharged.

The operation of an essential part of the fluidized-bed drying and classifying apparatus shown in FIG. 4 will be described. The fluidizing gas is jetted through the perforated gas-distributing plate 12 to form the fluidized bed 14 of the material to be processed and to dry the material. Lumps of the material are discharged through a lump dropping opening formed in the perforated gas-distributing plate 12 into the lump discharge system 27 and are discharged by the lump discharge system 27. The dried processed material is discharged by the processed material discharge system 31. Dropped particles dropped through the jetting holes of the perforated gas-distributing plate 12 are discharged by the dropped material discharge system 29.

The lump discharge system 27 is operated to discharge lumps contained in the material to be processed when the amount of coarse particles of particle sizes not smaller than the particle size that makes fluidized-bed superficial velocity and minimum fluidization velocity equal to each other (10 to 15 mm for drying coal) contained in the processed material increases beyond 3 to 8% by weight of the amount of the processed material.

The fluidized-bed drying and classifying apparatus in the second embodiment is the same in other respects relating to operation and construction as the fluidized-bed drying and classifying apparatus in the first embodiment.

Figure 5:
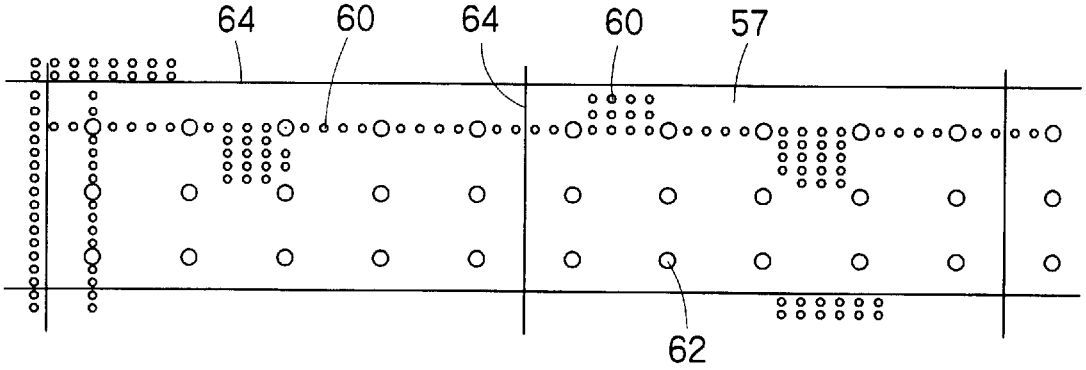
FIG. 5 is a plan view of a perforated gas-distributing plate provided with a liner thereon employed in the fluidized-bed drying and classifying apparatuses in the first and the second embodiment.
Figure 6:
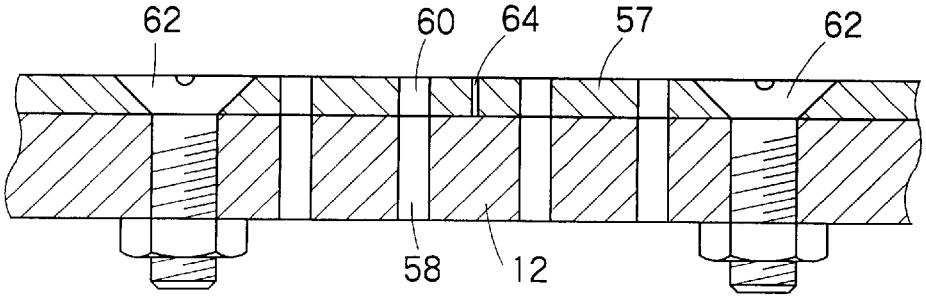
FIG. 6 is a schematic, enlarged sectional view of the perforated gas-distributing plate provided with a liner thereon employed in the fluidized-bed drying and classifying apparatuses in the first and the second embodiment.

FIGS. 5 and 6 show the perforated gas-distributing plate employed in the fluidized-bed drying and classifying apparatuses in the first and the second embodiment provided with a liner thereon to prevent the abrasion of the perforated gas-distributing plate. A liner 57 is attached detachably to the upper surface of the perforated gas-distributing plate 12 to prevent the abrasion of the perforated gas-distributing plate 12. The liner 57 provided with small holes corresponding to the jetting holes 58 of the perforated gas-distributing plate 12 is divided into a plurality of sections, and the sections of the liner 57 are fastened to the perforated gas-distributing plate 12 with flat head bolts 62 with the small holes 60 in alignment with the jetting holes 58. In FIGS. 5 and 6, indicated at 64 are division lines.

FIGS. 7 to 10 show essential parts of a fluidized-bed drying and classifying apparatus in a third embodiment according to the present invention and its modifications. The fluidized-bed drying and classifying apparatus in the third embodiment is characterized by its particle discharge device.

Figure 7:
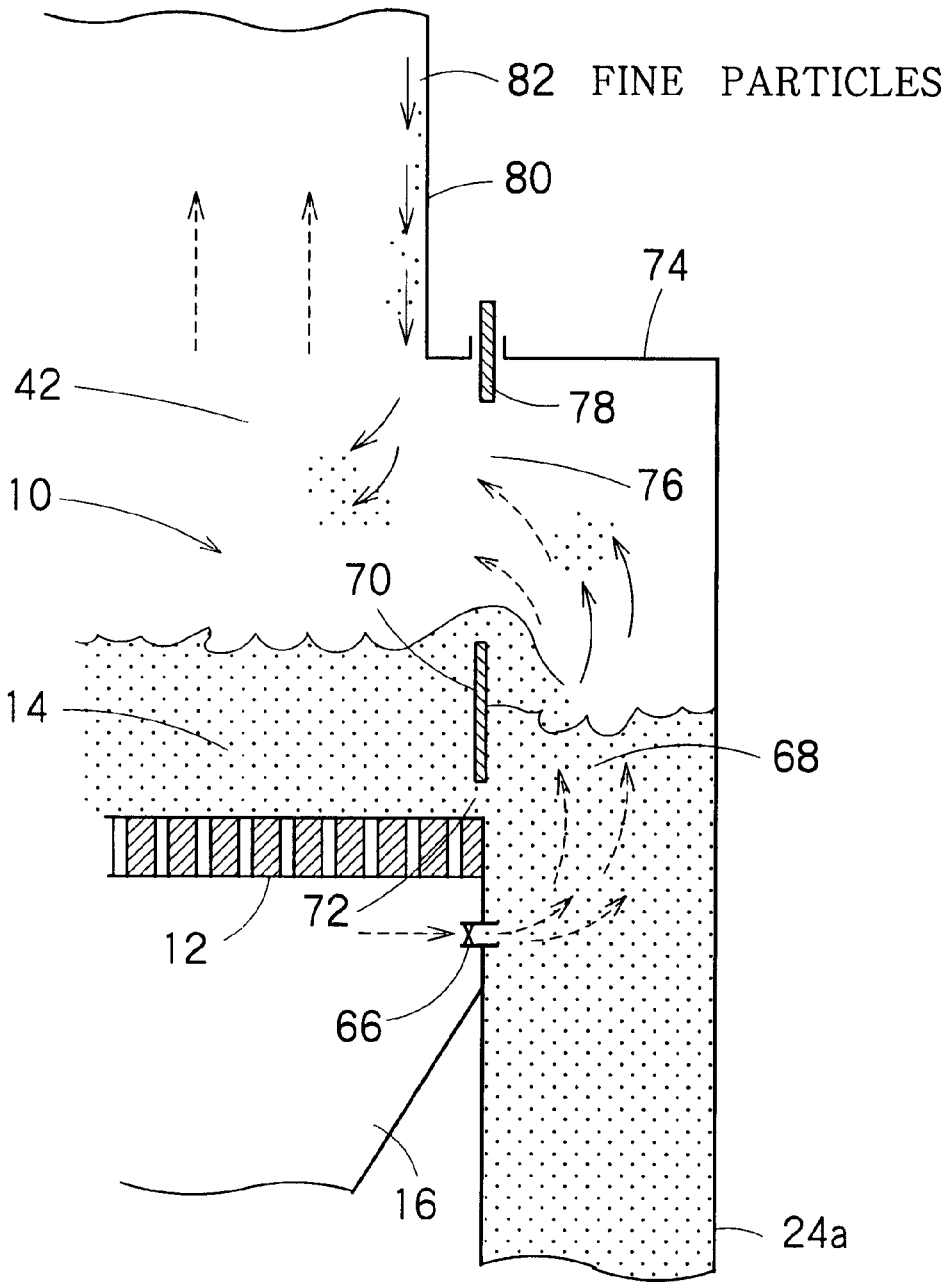
FIG. 7 is a schematic, enlarged sectional view of an essential part of a fluidized-bed drying and classifying apparatus in a third embodiment according to the present invention.

Referring to FIG. 7, a classifying gas blowing nozzle 66 is attached to a part of a side wall of a processed material discharge chute 24*a* in a wind box 16. A dam 70 is disposed in a processed material discharge portion 68 at a position near one end (a lower end with respect to the moving direction of particles) of a perforated gas-distributing plate 12. A gap (slit) 72 is formed between the lower end of the dam 70 and the upper surface of the perforated gas-distributing plate 12 so as to enable lumps or large particles pass through the gap 72.

A classifying plate 78 is disposed on the top wall 74 of a main body 10 in an upper part of the processed material discharge portion 68 to enhance classifying efficiency by reducing the sectional area of a space 76 between the dam 70 and the classifying plate 78. The dam 70 and the classifying plate 78 are movable for height adjustment.

The operation of the essential part of the fluidized-bed drying and classifying apparatus shown in FIG. 7 will be described, in which reference will be made to FIG. 1. A material to be processed containing particles having fine particles is supplied through a material supply opening portion 20 onto the perforated gas-distributing plate 12, a fluidizing gas is jetted through the perforated gas-distributing plate 12 to form a fluidized bed 14 of the particles. The material is classified into fine particles contained in the exhaust gas and coarse particles. Coarse particles as a product are discharged through the processed material discharge portion 68 and the processed material discharge chute 24*a*.

Part of the fluidizing gas (wind box gas) supplied into a wind box 16 is blown as a classifying gas through the classifying gas blowing nozzle 66 attached to the side wall of the processed material discharge chute 24*a* into the processed material discharge portion 68. The classifying gas flows through the space 76 over the dam 70 into the freeboard 42 in the main body 10 to prevent fine particles 82 falling along a side wall 80 of the main body 10 from entering the processed material discharge portion 68 and to return fine particles overflowing the dam 70 into the main body 10. Thus, classifying efficiency is improved.

The height of the dam 70 is adjusted to conform to the characteristic of the material to be processed. The width of the gap (slit) between the lower end of the dam 70 and the upper surface of the perforated gas-distributing plate 12 is adjusted according to the size of lumps or large particles. The height of the classifying plate 78, i.e., the position of the lower end of the classifying plate 78, is adjusted to change the sectional area of the space 76 so that the gas flows at an optimum velocity. In this embodiment, part of the fluidizing gas supplied into the wind box may be blown into the processed material discharge chute 24*a*.

Figure 8:
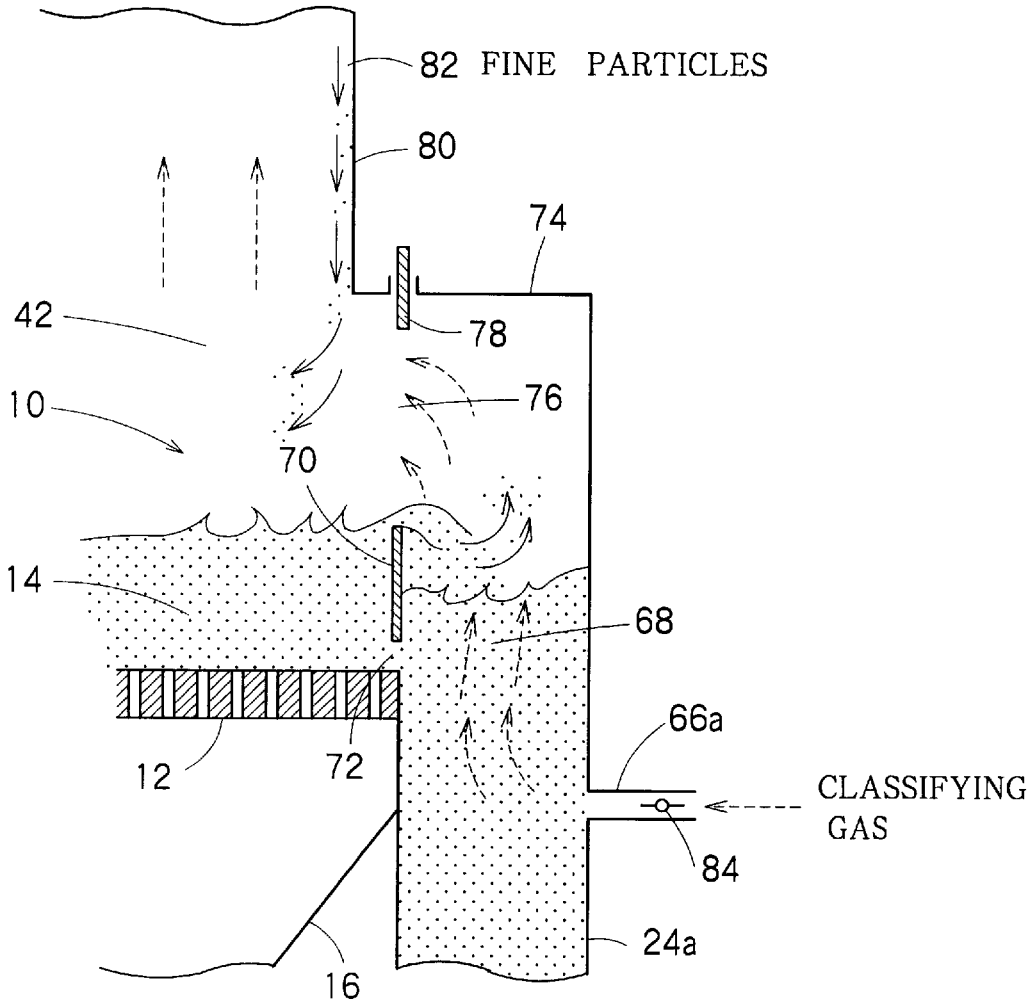
FIG. 8 is a schematic, enlarged sectional view of an essential part of a first modification of the fluidized-bed drying and classifying apparatus in the third embodiment.

FIG. 8 shows a fluidized-bed drying and classifying apparatus in a first modification of the fluidized-bed drying and classifying apparatus in the third embodiment. In the first modification, a classifying gas blowing nozzle 66*a* is attached to a part of a side wall of a processed material discharge chute 24*a* opposite a side wall contiguous with a wind box 16. In the first modification, the velocity of the flow rate of a classifying gas, such as $N_2$ gas, air or a combustion gas can be properly adjusted by a flow control valve, such as a damper 84. Therefore, classification ratio is adjustable and the fluidized-bed drying and classifying apparatus has an improved classifying ability. The fluidized-bed drying and classifying apparatus shown in FIG. 8 is the same in other respects relating to operation and construction as the fluidized-bed drying and classifying apparatus shown in FIG. 7.

Figure 9:
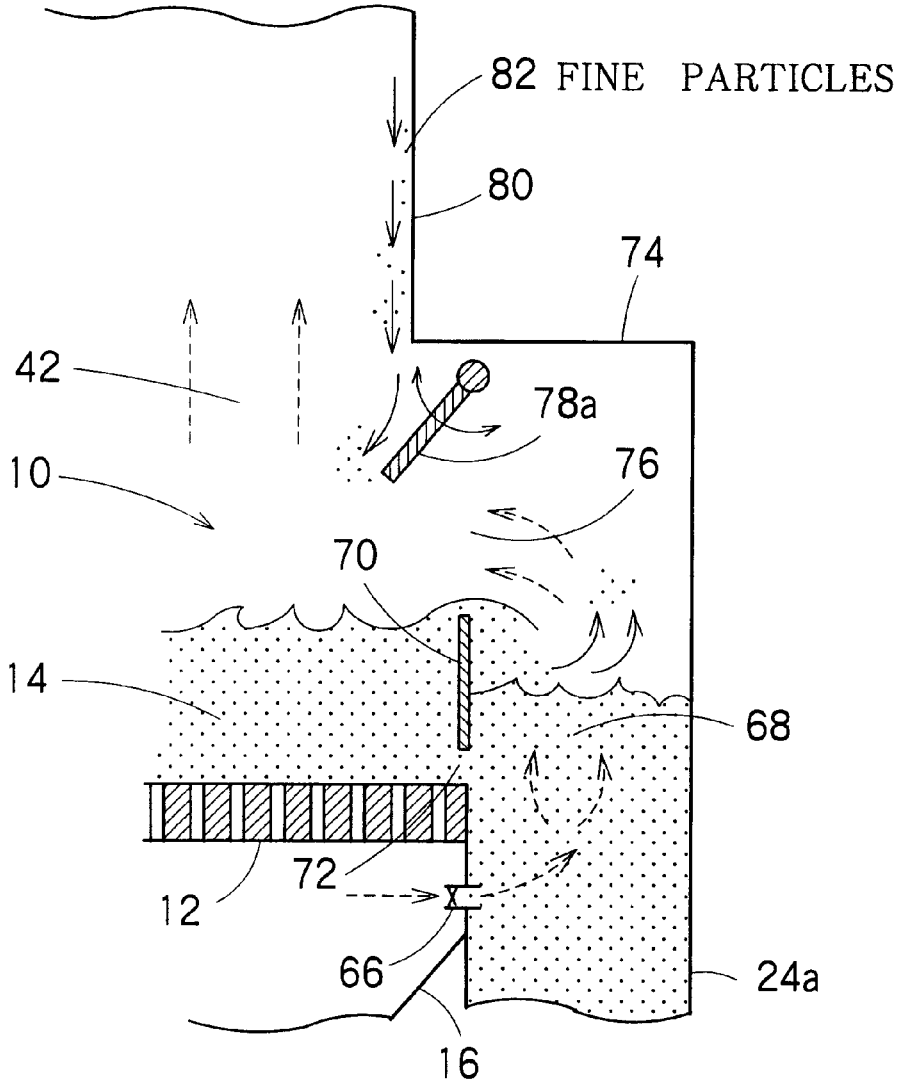
FIG. 9 is a schematic, enlarged sectional view of an essential part of a second modification of the fluidized-bed drying and classifying apparatus in the third embodiment.

FIG. 9 shows a fluidized-bed drying and classifying apparatus in a second modification of the fluidized-bed drying and classifying apparatus in the third embodiment. In the second modification, a swingable flap type classifying plate 78*a* is employed for changing the sectional area of a space 76 between a dam 70 and the classifying plate 78*a*. The classifying plate 78*a* is set in an inclined position sloping down toward the interior of a main body 10 to return fine particles 82 fallen thereon into the main body 10. The fluidized-bed drying and classifying apparatus in the second modification is the same in other respects relating to operation and construction as the fluidized-bed drying and classifying apparatus shown in FIG. 7.

Figure 10:
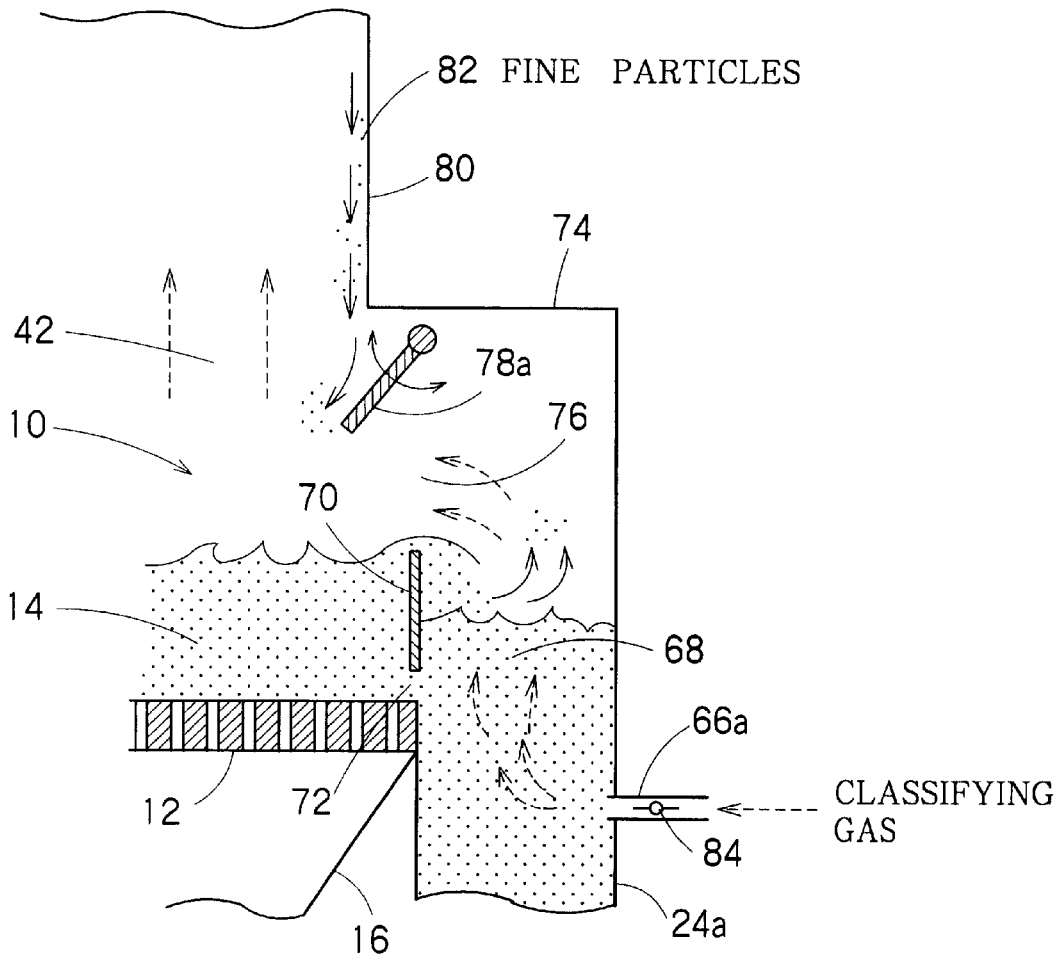
FIG. 10 is a schematic, enlarged sectional view of an essential part of a third modification of the fluidized-bed drying and classifying apparatus in the third embodiment.

FIG. 10 shows a fluidized-bed drying and classifying apparatus in a third modification of the fluidized-bed drying and classifying apparatus in the third embodiment. In the fluidized-bed drying and classifying apparatus shown in FIG. 10, a classifying gas blowing nozzle 66*a* is attached to a part of a side wall of a processed material discharge chute 24*a* opposite a side wall contiguous with a wind box 16, and a swingable flap type classifying plate 78*a* is employed. The third modification is the same in other respects relating to operation and construction as the fluidized-bed drying and classifying apparatuses shown in FIGS. 7 to 9.

The third embodiment is the same in other respects relating to operation and construction as the first embodiment. A perforated gas-distributing plate employed in the third embodiment may be provided with the replaceable liner shown in FIGS. 5 and 6.

FIGS. 11 to 14 show an essential part of a fluidized-bed drying and classifying apparatus in a fourth embodiment according to the present invention. The fourth embodiment is characterized by a particle discharge device.

Figure 11:
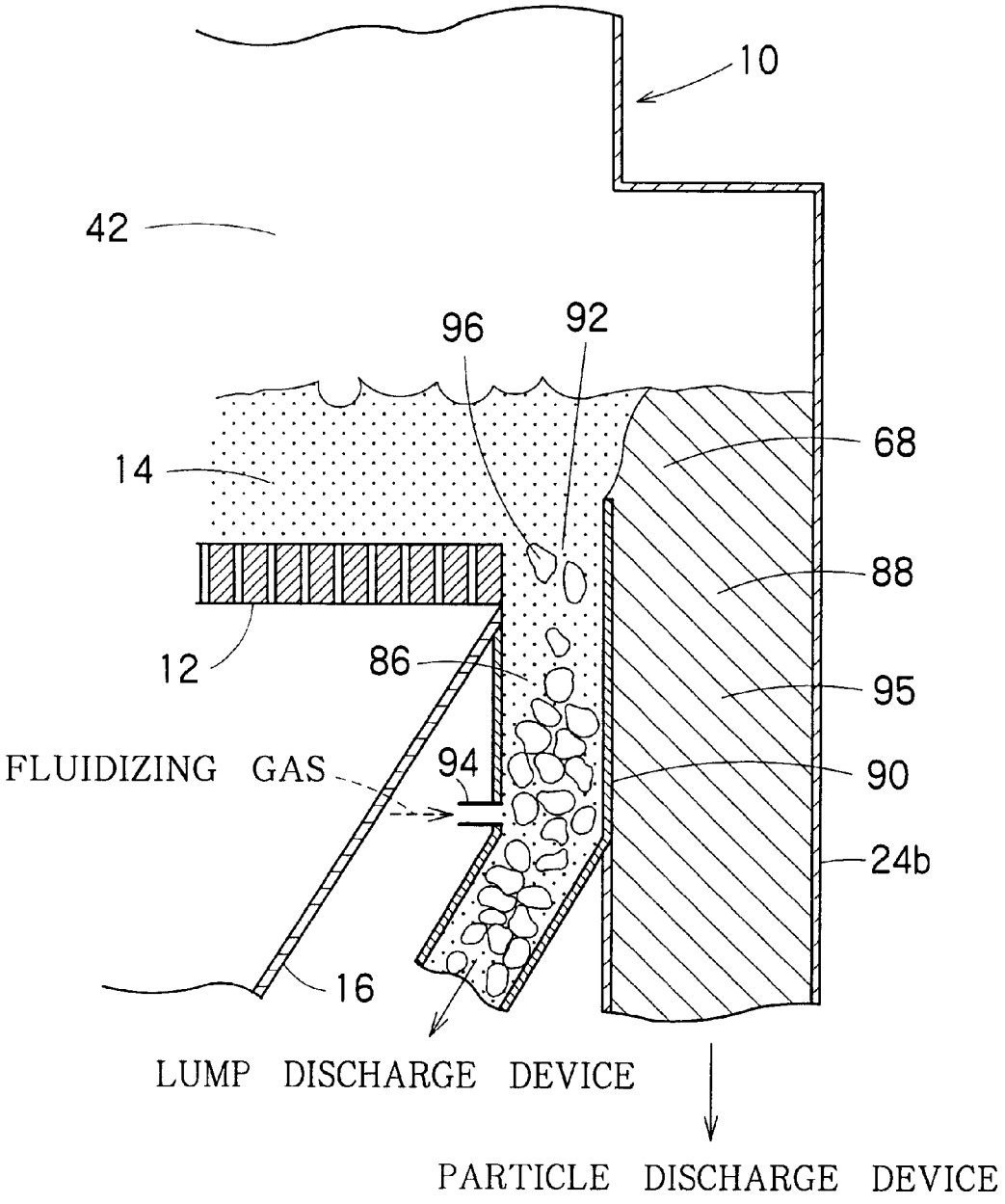
FIG. 11 is a schematic, enlarged sectional view of a fluidized-bed drying and classifying apparatus in a fourth embodiment according to the present invention.
Figure 12:
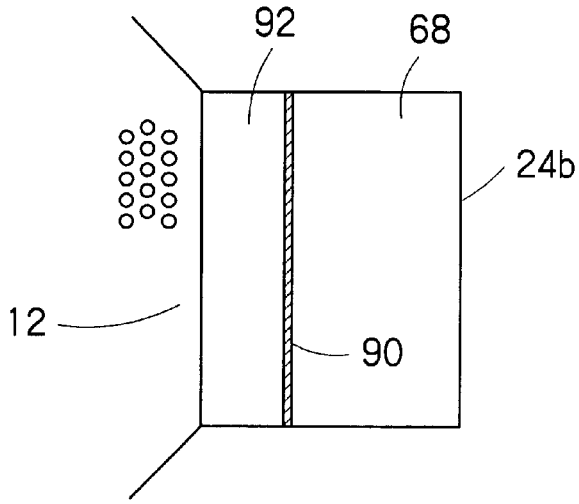
FIG. 12 is a schematic sectional plan view of a processed material discharge part shown in FIG. 11.

Referring to FIGS. 11 and 12, the interior of a processed material discharge chute 24*b* is divided by a partition wall 90 to form a lump discharge chute 86 on the side of a perforated gas distributing plate 12, and a particle discharge chute 88 on the side of one end of a main body 10. The partition wall 90 is extended substantially near to a lower discharge end. In FIGS. 11 and 12, indicated at 92 is a lump discharge part (lump discharging outlet). A fluidizing gas blowing nozzle 94 is attached to one side wall of the lump discharge chute 86.

A lump discharge device, not shown, is connected to the lump discharge chute 86, and a particle discharge device, not shown, is connected to the particle discharge chute 88.

The operation of the particle discharge device of the fluidized-bed drying and classifying apparatus shown in FIGS. 11 and 12 will be described, in which reference will be made also to FIG. 1. A material including lumps and particles is supplied through a material supply opening portion 20 onto a perforated gas-distributing plate 12. A gas is jetted through the perforated gas-distributing plate 12 to form a fluidized bed 14 by fluidizing the particles. The material is dried and classified, and a processed material (coarse particles), i.e., a product, is discharged through a processed material discharge portion 68 via the particle discharge chute 88. In FIG. 11, indicated at 95 is a moving particle layer.

A fluidizing gas is blown through the fluidizing gas blowing nozzle 94 attached to the side wall of the lump discharge chute 86 into the lump discharge chute 86 to fluidize particles in an upper region of the lump discharge chute 86 and to make lumps 96 fall in the lump discharge chute 86. The fluidizing gas may be cold air, hot air, combustion gas or an inert gas, such as $N_2$ gas. The fluidizing gas is blown through the fluidizing gas blowing nozzle 94 into the lump discharge chute 86 so that the velocity of the fluidizing gas in an upper part of the lump discharge chute 86 is in the range of 1 to 3 times, more desirably, in the range of 1.5 to 2 times the minimum fluidization velocity $U_{mf}$ for the fluidized bed 14.

Figure 13:
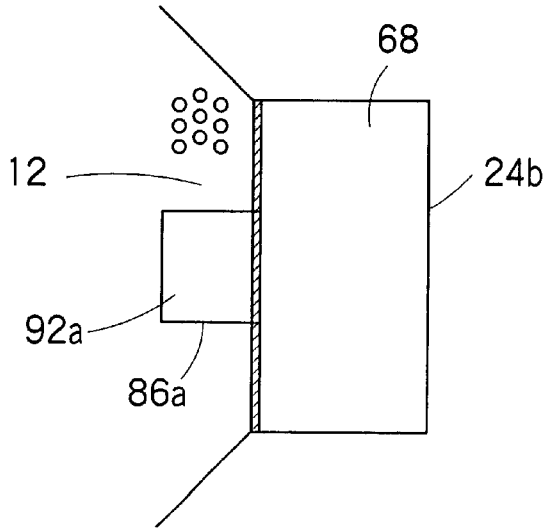
FIG. 13 is a schematic sectional plan view of a processed material discharge part in a modification of the processed material discharge part of the fluidized-bed drying and classifying apparatus in the fourth embodiment.

FIG. 13 shows a fluidized-bed drying and classifying apparatus in a first modification of the fluidized-bed drying and classifying apparatus in the fourth embodiment. In the fluidized-bed drying and classifying apparatus shown in FIG. 13, a processed material discharge chute 24*b* is not divided, a lump discharge unit (lump discharge portion) 92*a* is disposed contiguously with the processed material discharge chute 24*b* on the side of a perforated gas-distributing plate 12, and a lump discharge chute 86*a* is connected to the lump discharge unit 92*a*. The fluidized-bed drying and classifying apparatus in the first modification is the same in other respects relating to operation and construction as the fluidized-bed drying and classifying apparatus shown in FIGS. 11 and 12.

Figure 14:
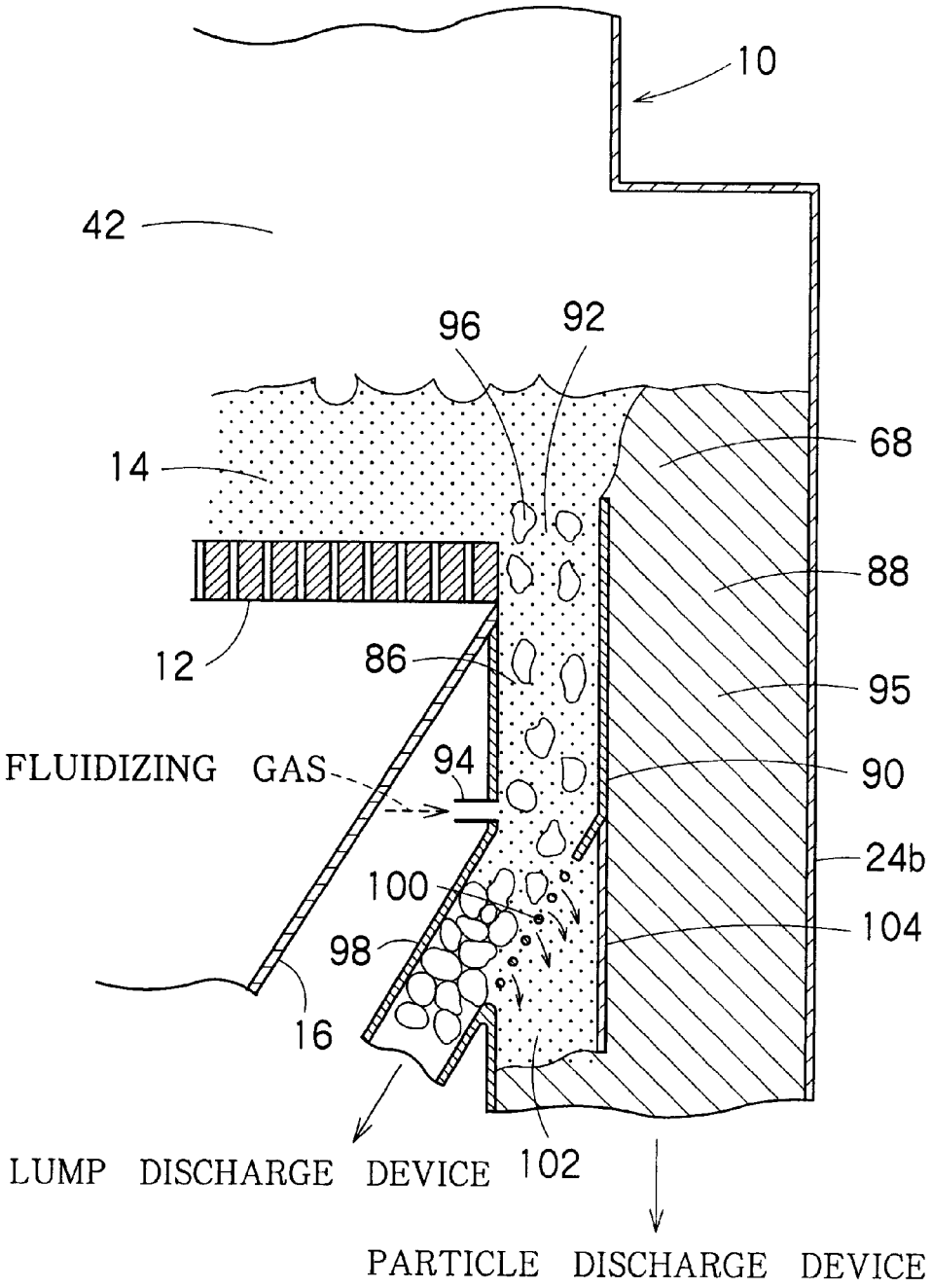
FIG. 14 is a schematic, enlarged sectional view of another essential part of the fluidized-bed drying and classifying apparatus in the fourth embodiment.

FIG. 14 shows a fluidized-bed drying and classifying apparatus in a second modification of the fluidized-bed drying and classifying apparatus in the fourth embodiment. In the second modification, a lower part 98 of a lump discharge cute 86, for example, a lower part 98 below a fluidizing gas blowing nozzle 94, is inclined. A sieve structure 100 is formed in a part of a partition wall or an entire partition wall of the inclined lower part 98 on the side of the particle discharge chute 24*b*. A space securing partition wall 104 is disposed in the processed material discharge chute 24*b* so as to secure a space 102 under the sieving structure 100. Small particles fallen into the lump discharge chute 86 are sieved out by the sieving structure 100. Thus, the small particles sieved out by the sieving structure 100 are delivered through the space 102 into the processed material discharge chute 24*b*, more specifically, into a particle discharge chute 88. The fluidized-bed drying and classifying apparatus in the second modification is the same in other respects relating to operation and construction as the fluidized-bed drying and classifying apparatus shown in FIGS. 11 and 12.

The fourth embodiment of the present invention is the same in other respects relating to operation and construction as the first embodiment. A perforated gas-distributing plate employed in the fourth embodiment may be provided with the replaceable liner shown in FIGS. 5 and 6.

INDUSTRIAL APPLICABILITY

The fluidized-bed drying and classifying apparatus according to the present invention is used for the hot-air drying of granular material having a wide particle size distribution, such as coal or slag and for the air classification of the granular material into fine particles and coarse particles.

What is claimed is:

1. A fluidized-bed drying and classifying apparatus having a main body in which a fluidized bed is formed to dry a granular material and to classify the granular material into fine particles and coarse particles said fluidized-bed drying and classifying apparatus comprising:

a perforated gas-distributing plate disposed under a fluidized bed forming region in the main body;

a wind box having a shape of a hopper and disposed below the perforated gas-distributing plate;

a dropped material discharge device connected to a lower end of the wind box to continuously discharge the material dropped into the wind box;

a gas supply system connected to the wind box to supply a fluidizing gas that serves as a drying hot gas and a classifying gas into the wind box;

a material supply opening portion mounted to the main body to feed the granular material;

a discharge chute mounted to the main body to discharge dried coarse particles; and a gas discharge opening portion disposed on an upper part of the main body to discharge an exhaust gas containing fine particles;

wherein the gas supply system includes a flow controller to control a classification particle size by controlling a flow rate of the gas supplied into the wind box, and a temperature controller to control a drying degree through an adjustment of a temperature of the gas supplied into the wind box according to the flow rate adjusted by the flow controller.

2. The fluidized-bed drying and classifying apparatus according to claim 1, wherein a lump discharge device is connected to the perforated gas-distributing plate disposed under the fluidized bed forming region directly below the material supply opening portion to discharge large coarse particles having a particle size not smaller than a particle size that makes a fluidized-bed superficial velocity and an minimum fluidization velocity equal to each other.

3. The fluidized-bed drying and classifying apparatus according to claim 1, wherein a replaceable liner is attached to the perforated gas-distributing plate to prevent an abrasion of the perforated gas-distributing plate.

4. The fluidized-bed drying and classifying apparatus according to claim 1, wherein a dam is disposed near an end of the perforated gas-distributing plate on a side of the discharge chute, and a classifying gas supply nozzle is connected to the discharge chute to return the fine particles into the main body by blowing up the fine particles over the dam.

5. The fluidized-bed drying and classifying apparatus according to claim 4, wherein a gap through which a large lump can pass is formed between a lower end of the dam and an upper surface of the perforated gas-distributing plate.

6. The fluidized-bed drying and classifying apparatus according to claim 1, wherein a dam is disposed near an end of the perforated gas-distributing plate on a side of the discharge chute, a classifying plate is disposed above the dam to improve a classifying efficiency by reducing a sectional area of a space between the dam and the classifying plate, and a classifying gas supply nozzle is connected to the discharge chute to return fine particles into the main body by blowing a gas through the space between the dam and the classifying plate.

7. The fluidized-bed drying and classifying apparatus according to claim 6, at least either a height of the dam or a height of the classifying plate is adjustable so that an amount of classification can be adjusted by changing the sectional area of the space between the dam and the classifying plate.

8. The fluidized-bed drying and classifying apparatus according to claim 6, wherein at least either a height of the classifying plate or an angle of the classifying plate is adjustable to adjust an amount of classification by changing the sectional area of the space between the dam and the classifying plate.

9. The fluidized-bed drying and classifying apparatus according to claim 1, wherein the discharge chute is divided by a partition wall to form a lump discharge chute in the discharge chute on a side of the perforated gas-distributing plate and a fluidizing gas blowing nozzle is mounted to the lump discharge chute for fluidizing particles in an upper part of the lump discharge chute to make a large lump fall selectively and to discharge the large lump.

10. The fluidized-bed drying and classifying apparatus according to claim 9, wherein an upper end of the partition wall is on a level above an upper surface of the perforated gas-distributing plate.

11. The fluidized-bed drying and classifying apparatus according to claim 1, wherein a lump discharge portion is mounted at a discharging part of the discharge chute on a side of the perforated gas-distributing plate, a lump discharge chute is connected to the lump discharge portion, and a fluidizing gas blowing nozzle is mounted to the lump discharge chute to fluidize particles in an upper part of the lump discharge chute to make a large lump fall selectively and to discharge the large lump.

12. The fluidized-bed drying and classifying apparatus according to claim 1, wherein the discharge chute is divided by a partition wall so as to form a lump discharge chute in the discharge chute on a side of the perforated gas-distributing plate, a fluidizing gas blowing nozzle is mounted to the lump discharge chute to fluidize particles in an upper part of the lump discharge chute to make a large lump fall selectively and to discharge the large lump, a lower part of the lump discharge chute is inclined, a sieving structure is formed in at least a part of a lower wall of the inclined lower part of the lump discharge chute, a partition wall is disposed in the discharge chute so as to define a space below the sieving structure, and particles of a small particle size dropped in the lump discharge chute is sieved out into the space below the sieving structure and is returned into the discharge chute.

* * * * *